US005917394A

United States Patent [19]

Fuchs

[11] Patent Number: 5,917,394

[45] Date of Patent: Jun. 29, 1999

[54] SOLENOID SWITCH MODIFIED FOR HIGHER CURRENT PASSAGE

[76] Inventor: Michael J Fuchs, Box 191, Rockford, Wash. 99030

[21] Appl. No.: 09/204,661

[22] Filed: Dec. 1, 1998

[51] Int. Cl.[6] ..... H01F 7/00

[52] U.S. Cl. ..... 335/229; 335/126; 335/131; 335/251; 335/255

[58] Field of Search ..... 335/229, 126, 335/251, 255, 131, 127

[56] References Cited

U.S. PATENT DOCUMENTS

| | | | |
|---|---|---|---|
| 2,521,969 | 9/1950 | Dugan | 335/131 |
| 3,154,655 | 10/1964 | Hawkins | 335/131 |
| 3,699,486 | 10/1972 | De Lucia | 335/131 |
| 3,716,811 | 2/1973 | Prouty et al. | 335/160 |
| 4,041,426 | 8/1977 | Zemanek et al. | 335/131 |

OTHER PUBLICATIONS

Delco Catalog, pp. 90, 91, Advertised 1998.

*Primary Examiner*—Michael L. Gellner
*Assistant Examiner*—Tuyen T. Nguyen
*Attorney, Agent, or Firm*—David S. Thompson

[57] ABSTRACT

A solenoid switch 10 modified for higher current passage provides a case 20 containing an electromagnetic coil 30 within which slides a cylindrical post 50. A first stage 60 and a second stage 80, stacked on an open end of the case, each include electrically conductive disks which alternate between electrically conductive states, wherein electrical current is transported between opposed electrical conductors 40, and a nonconductive state wherein an open circuit exists between the conductors 40. An air inlet 82 and associated air outlet 83 allow the use of compressed air to cool the conductive disks. An optional third stage 100 provides a further conductive disk which further reduces electrical resistance and heat production.

2 Claims, 5 Drawing Sheets

SOLENOID SWITCH MODIFIED FOR HIGHER CURRENT PASSAGE

CROSS-REFERENCES

There are no applications related to this application filed in this or any foreign country.

BACKGROUND—FIELD OF THE INVENTION

The invention relates to a solenoid switch adapted for the high amperage DC current flow required by DC welding applications.

BACKGROUND—DESCRIPTION OF THE PRIOR ART

Solenoid switches have long been used in applications where control of a large current is required by a given control switch, but it is unsafe or impractical to carry the current through the control switch. While such solenoid switches have been perfected for use in the operation of automotive type starters, such switches are not well-suited to the needs of direct current welding. Making small spot welds with DC current requires amperage that is in excess of that used in automotive applications. As a result, the cost-effective solenoid switches available from automotive sources are seriously under-rated for use in a welding application. As a result, known DC welding machines plug into AC power and use transformers and rectifiers to supply DC current for welding.

A typical solenoid switch provides an electromagnetic coil, which when activated, moves a ferrous metal cylinder into the coil, causing an electrically conducting disk carried by the cylinder to connect two electrical contacts. When the power to the solenoid is discontinued, the magnetic field of the coil collapses, and a spring returns the cylinder to its original position releasing the electrically conducting disk connecting the two electrical contacts.

When such a solenoid switch is used with current exceeding the rated value, it is common for the solenoid to fail due to the electrically conducting disk becoming welded onto the two electrical contacts. This is due to the heat generated by resistance to the heavy electrical current flow. It is to a solution to this failure mechanism that the instant invention is directed.

Previous solenoid switches have generally provided three forces that tend to resist failure caused by the electrically conducting disk becoming welded to the electrical contacts. First, some solenoid switches are mounted in a manner that orients the coil and cylinder so that gravity tends to pull the cylinder from the coil. As a result, the weight of the cylinder tends to aid somewhat in breaking any weld that has formed between the electrically conducting disk and the electrical contacts. Secondly, a weak cylinder biasing spring is typically carried by the cylinder. This spring biases the cylinder out of the coil, and tends to apply a force against the electrically conducting disk in the event that it is welded to the electrical contacts. Unfortunately, the force of gravity and the cylinder biasing spring urging the cylinder from the coil tend to have insufficient force to break a weld between the electrically conducting disk and electrical contacts.

Thirdly, a much stronger electrically conducting disk biasing spring is typically used to bias the electrically conducting disk firmly against the electrical contacts when the cylinder is inside the coil as a means of increasing electrical conductivity and reducing the heat associated with electrical resistance. Considerably more energy is stored in the spring biasing the electrically conducting disk to the electrical contacts than is stored in either the movement against gravity of the weight of the cylinder or in compression of the cylinder biasing spring. However, when the solenoid switch is used significantly in excess of its rating, currently known structures fail to counteract this failure mechanism.

Currently, solenoids rated for heavier than typical automotive current levels, such as those use in large trucks, have generally provided components having increased the size and weight, but generally the same design. The resulting apparatus is therefore not more sophisticated, but is more costly, as well as heavier and bulkier.

What is needed is an improved design for an automotive or similar type solenoid switch that will allow it to carry much heavier current levels, yet not appreciably increase cost, weight or size. The improved design must adequately address the problem of the copper conducting element welding onto the electrical contacts.

SUMMARY

The present invention is directed to an apparatus that satisfies the above needs. A novel solenoid switch modified for higher direct current passage includes some or all of the following structures.

(A) A case is typically made of steel or other durable material, having a cylindrical sidewall. A first end is closed, while a second end is open typically supports first and second stages, which in turn support a cap.

(B) A electromagnet coil is carried within the case, adjacent to the closed end.

(C) A ferrous metal core is carried within a portion of the cavity defined by the coil, adjacent to the closed end. A preferred core defines a spring recess which can carry a portion of a cylinder biasing spring.

(D) A sliding post is carried within the case, and is movable between conducting and non-conducting positions. In the conducting position, the solenoid switch is turned on; in the non-conducting position the solenoid switch is turned off. A preferred version of the sliding post includes:

(a) A main body is sized for passage within the portion of the cavity of the coil not filled by the partial core. A preferred version of the main body defines a spring recess similar to that of the ferrous metal core.

(b) A neck extends from the main body, and a shaft extends from the neck.

(E) A cylinder biasing spring is carried between the spring recess of the core and the spring recess of the main body of the sliding post, and tends to urge the sliding post partially out of the electromagnetic coil when the coil is not activated, but is too weak to push the sliding cylinder when the coil is activated.

(F) A preferred version of the first stage includes a cylindrical body sized for attachment to the case, and provides a switching mechanism controlling the conductivity between first and second electrical connectors, typically including:

(a) An insulating disk is carried by the shaft and is in contact with the neck.

(b) A first insulating spring support disk is adjacent to the insulating disk and is carried by the shaft. An upper surface defines a perimeter rim sized to support the first conductive disk biasing spring. A lower body is sized to fit within the opening in the first electrically conductive disk, thereby preventing that disk from making electrical contact with the shaft.

(c) A first electrically conductive disk is carried by the lower body of the first insulating spring support disk. The first electrically conductive disk is sized to span between the contact surfaces of the first and second electrical conductors, and provides electrical continuity when the sliding post is in the conducting position.

(d) A first conductive disk biasing spring is carried by the shaft, with a first end portion carried within the perimeter rim of the insulating spring support disk.

(e) A first spring cap is carried by the shaft and is sized to carry a second end portion of the first conductive disk biasing spring.

(G) First and second electrical connectors pass through, and are carried by, diametrically opposed positions of the cylindrical body carried by the case. Each connector provides: an outside portion includes a threaded bolt extending from a contact surface; an inside portion includes an inside contact with a contact surface, whereby the contact surfaces of the first and second electrical connectors will contact the first electrically conductive disk when the sliding post is in the conducting position, but whereby the contact surfaces of the first and second electrical connectors do not contact the first electrically conductive disk when the sliding post is in the nonconducting position.

(H) A preferred version of the second stage includes a cylindrical body sized for attachment to the first stage, and provides a switching mechanism controlling the conductivity between first and second electrical connectors, typically including:

(a) A cylindrical body that is sized to fit the second open end of the case.

(b) Air inlet and air outlet connectors to allow the attachment of a compressed air source, and to thereby promote the circulation of air within the case and cylindrical body, in a manner that results in the removal of the excess heat generated when the sliding post is in the conducting position.

(c) At least one spacing cylinder, and optionally one or more washers, are carried by the shaft adjacent to the electrically insulating disk, the cumulative axial length which directly controlling the tension of the second conducting disk biasing spring.

(d) A second electrically insulating disk is carried by the shaft adjacent to the spring cap of the first stage.

(e) A second insulating spring support disk is adjacent to the second insulating disk and is carried by the shaft. An upper surface defines a perimeter rim sized to support a support the second conductive disk biasing spring. A lower body is sized to fit within the opening in the second electrically conductive disk, thereby preventing that disk from making electrical contact with the shaft.

(f) A second electrically conductive disk is carried by the lower body of the second insulating spring support disk. The second electrically conductive disk is sized to span between the contact surfaces of the third and fourth electrical conductors, and provides electrical continuity when the sliding post is in the conducting position.

(g) A second conductive disk biasing spring is carried by the shaft, with a first end portion carried within the perimeter rim of the insulating spring support disk.

(h) A second spring cap is carried by the shaft and sized to carry a second end portion of the second conductive disk biasing spring.

(i) A fastener is carried by the shaft and retains the spring cap.

(I) Third and fourth electrical connectors, passing through and carried at diametrically opposed positions on the second cylindrical body, each connector provides: an outside portion which includes a threaded bolt extending from a contact surface; an inside portion which includes an inside contact having a contact surface, whereby the contact surfaces of the third and fourth electrical connectors may contact the second electrically conductive disk when the sliding post is in the conducting position, but whereby the contact surfaces of the third and fourth electrical connectors may not contact the second electrically conductive disk when the sliding post is in the non-conducting position.

It is therefore a primary advantage of the present invention to provide a novel solenoid switch modified for higher current passage that is air-cooled, and which therefore is resistant to the principle cause of failure, which is overheating.

Another advantage of the present invention is to provide a novel solenoid switch modified for higher current passage that that has a multi-stage design, which results in the redistribution of current through a greater number of electrically conductive disks, thereby reducing electrical resistance and therefore heat production.

A still further advantage of the present invention is to provide a novel solenoid switch modified for higher current passage that provides spacing cylinders supported on the shaft of the sliding post that allow independent adjustment of the pressure applied to each of the electrically conductive disks, which in turn allows equalization of the pressure applied to a number of such disks.

DRAWINGS

These and other features, aspects, and advantages of the present invention will become better understood with regard to the following description, appended claims, and accompanying drawings where:

DESCRIPTION

Figure 1:
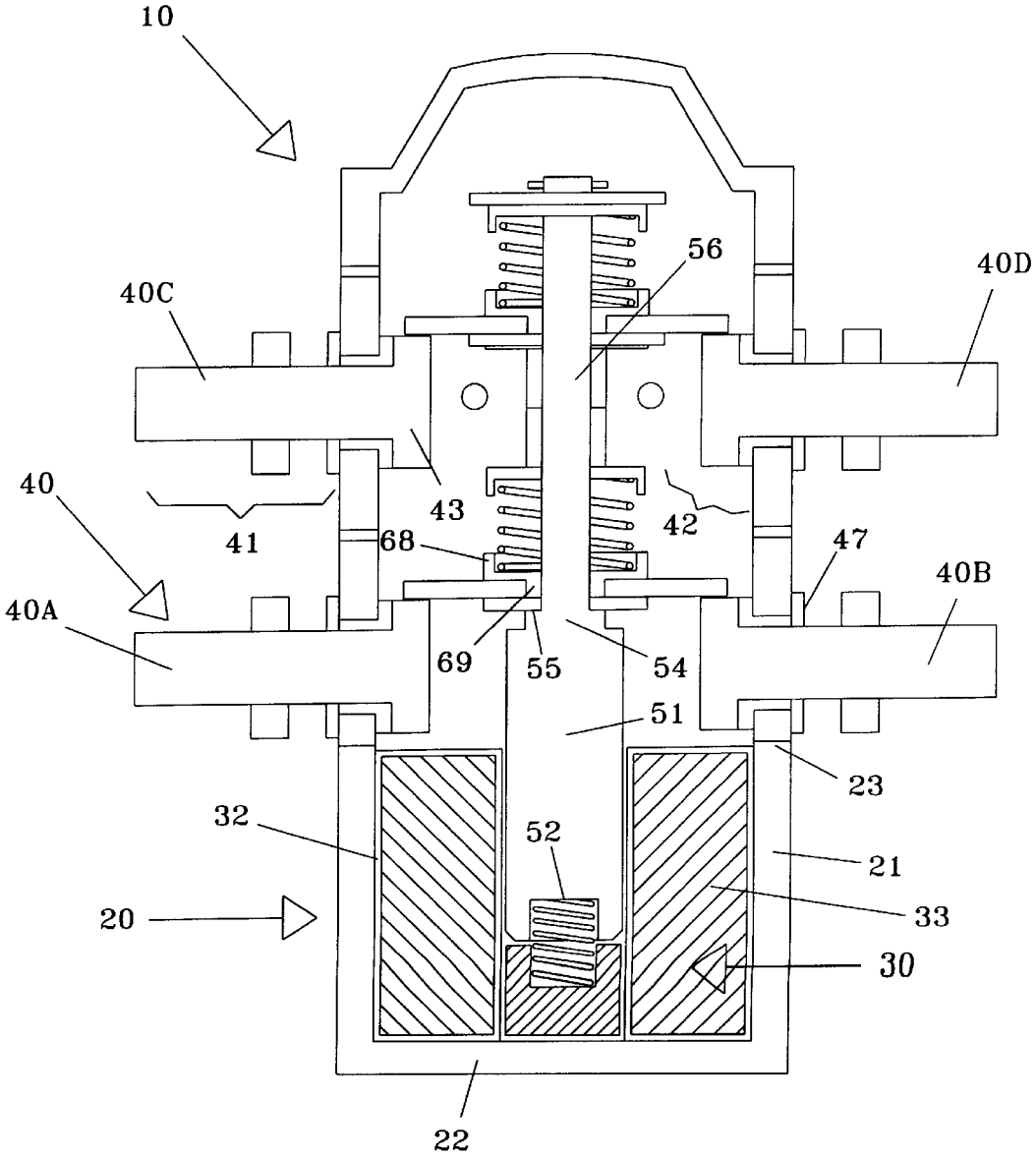
FIG. 1 is an isometric cross-sectional view of a version of the solenoid switch modified for higher current passage having a two-stage design, wherein the sliding post is fully withdrawn into the coil, assuming a conducting position in which the switch is closed.
Figure 2:
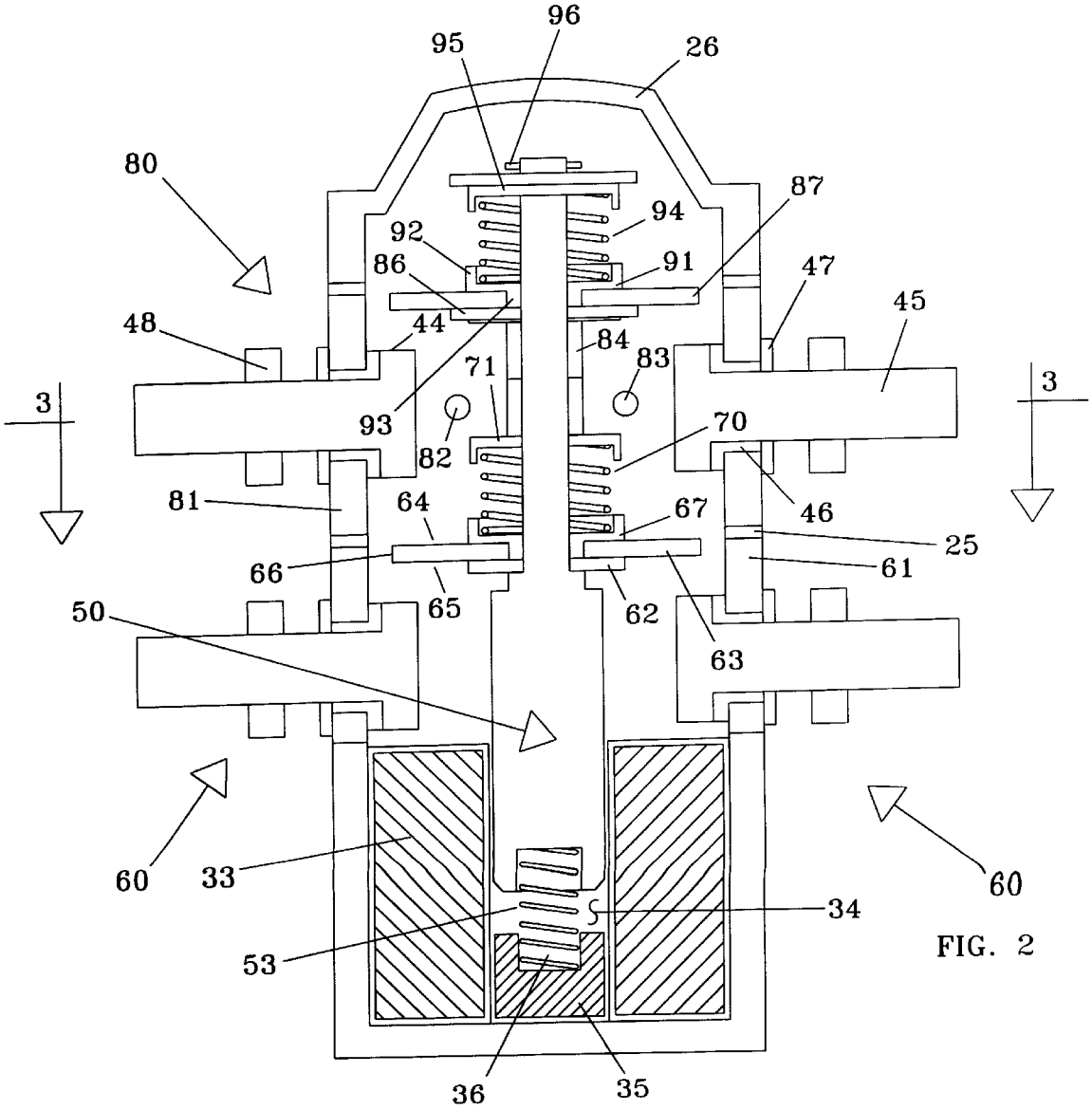
FIG. 2 is an isometric cross-sectional view of the solenoid switch of FIG. 1, wherein the cylinder post is fully extended, assuming a non-conducting position in which the switch is open.
Figure 3:
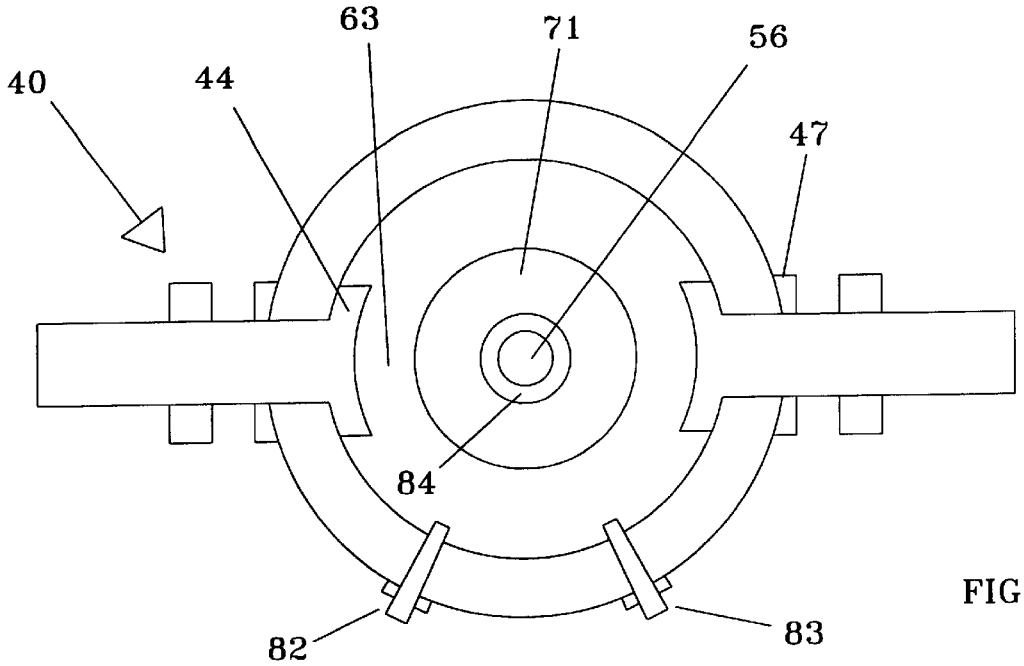
FIG. 3 is an isometric cross-sectional view of the solenoid switch taken along the 3—3 lines of FIG. 2.

Referring in generally to FIGS. 1 and 2, a solenoid switch 10 modified for higher current passage constructed in accordance with the principles of the invention is seen. A case 20 contains an electromagnetic coil 30 within which slides a cylindrical post 50. A first stage 60 and a second stage 80, stacked on an open end of the case, each include electrically conductive disks 62, 87 which alternate between electrically conductive states, wherein electrical current is transported between opposed electrical conductors 40, and a nonconductive state wherein an open circuit exists between the conductors 40. An air inlet 82 and associated air outlet 83 allow the use of compressed air to cool the conductive disks. An optional third stage 100 provides a further conductive disk which further reduces electrical resistance and heat production.

Referring to FIGS. 1 through 4, a version of the case 20 is seen. A preferred case is made of steel or other durable material. The case is typically provides a cylindrical sidewall or body 21 having one closed end 22 and one open end 23. A bracket 24 may be carried by an outer surface of the cylindrical body 21, and may be used to mount the case in a desired location.

The case and the cylindrical bodies 61, 81 of the first and second stages 60, 80 are typically separated by a seal 25, which results in a nearly air-tight connection. A cap or lid 26 is carried by the uppermost stage, typically the second stage as seen in FIGS. 1 and 2, and is separated by a similar seal 25.

A coil 30 is used to withdraw the main body 51 of the sliding post 50, against the bias of springs 53, 70, 93, from the nonconducting position seen in FIG. 2 to the conducting position seen in FIG. 1. The coil is activated by application of voltage across the threaded electrical contact posts 31. Movement of the sliding post into the position seen in FIG. 1 must overcome the bias of the conductive disk biasing springs 70, 93 and the cylinder biasing spring 53. The coil 30 is carried within a coil enclosure 32 which prevents it from shorting out against the case 20. The coil is formed in a standard manner from wire turns 33. Within the coil is a cavity 34 which is substantially hollow, but in a preferred embodiment includes a partial metallic core 35 which defines a spring recess 36 sized to fit the lower portion of the cylinder biasing spring 53.

Where only a first stage 60 is used, the coil can be smaller than in a typical application, where a second stage 80 is present. Where a third stage 100 is used, the coil must be sufficiently large to overcome the springs associated with each electrically conductive disk.

As seen in FIGS. 1 through 4, a pair of electrical connectors 40 are associated with each conductive disk 63, 87. Each connector provides an outside portion 41 and an outside portion 42. An insulator 46 may be used in some applications to provide electrical isolation.

A preferred version of the outside portion, extending outside the case 20, includes a threaded bolt 45 extending perpendicularly from an outside contact surface 47. A nut or other fastener 48 may be used to attach a conductor.

The inside portion 42 is carried within the case, and includes an inside contact 43 having a contact surface 44 which is oriented to make electrical connection with the contact surface 65, 89 of the conductive disks 63, 87.

As seen in the cross-sectional views, a sliding post 50 is movable between a nonconducting position, seen in FIG. 2, to a conducting position, seen in FIG. 1. A preferred version of the sliding post includes a main body 51 made of ferrous metal, typically defining a spring recess 52 sized to fit an upper portion of the cylinder biasing spring 53. The cylinder biasing spring 53 urges the main body 51 out of the cavity 34 of the coil. A shaft 56 extends from the shoulder 55 adjacent a short neck 54. The shaft 56 supports the conductive disks and other hardware associated with a first stage 60, a second stage 80 and in some applications a third stage 100.

A first stage 60 includes a cylindrical body portion 61, which is carried by the case against a seal 25, as seen in FIGS. 1 and 2. First and second electrical connectors 40A, 40B are mounted on, and extend through, the cylindrical body portion. An insulating disk 62 is carried by the shaft adjacent to the neck. An insulating spring support disk 67 is also carried by the shaft, adjacent to the insulating disk. The insulating spring support disk provides a rim 68 sized to support a conductive disk biasing spring 70 and a lower body 69 sized to fit within the central hole defined in the first electrically conductive disk 63. The conductive disk 63 is carried by the lower body 69, and is therefore held between the insulating disk 62 and the insulating spring support disk 67 in a manner which prevents electrical contact between the conductive disk 63 and the shaft 56. The conductive disk 63 has an upper surface 64, a perimeter rim 66 and a contact surface 65 which makes electrical contact with the contact surface 44 of an associated inside contact 43.

A spring cap 71 is carried by the shaft, and secures the upper portion of the spring 70 in a manner that prevents undesired lateral movement. A conductive disk biasing spring 70 is carried between the perimeter rim 68 of the insulating support disk 67 and the spring cap 71. When the sliding cylindrical post 50 is in the nonconducting position, seen in FIG. 2, the spring is relaxed. When the sliding cylindrical post 50 is in the conducting position, seen in FIG. 1, the spring is compressed. The force of the coil pulling the main body 51 into the cavity 34 causes the compression. The compressed spring 70 forces the conductive disk 63 firmly against the contact surface 44, thereby reducing electrical resistance.

A second stage 80 includes a cylindrical body portion 81 which is carried by the first stage 60. An air inlet 82 and an air outlet 83 are defined through the body 81, having hardware fasteners to allow easy connection to standard compressed air hose fittings. The air inlet and air outlet allow compressed air to be introduced into the case 20 where it will remove heat from the conductive disks 62, 87 before exiting through the air outlet.

One or more spacing cylinders 84 and washers 85 are carried on the shaft adjacent to the spring cap 71. The axial length of the spacing cylinders and washers is closely related to the pressure with which the second electrically conductive disk 87 presses on the contact surface 44.

An insulating disk 86 is carried by the shaft adjacent to the spacing cylinder 84, if present, or washer 85. An insulating spring support disk 91 is also carried by the shaft, adjacent to the insulating disk 86. The insulating spring support disk provides a rim 92 sized to support a conductive disk biasing spring 94 and a lower body 93 sized to fit within the central hole defined in the second electrically conductive disk 87. The conductive disk 87 is carried by the lower body 93, and is therefore held between the insulating disk 86 and the insulating spring support disk 91 in a manner that prevents electrical contact between the conductive disk 87 and the shaft 56. The conductive disk 87 has an upper surface 88, a perimeter rim 90 and a contact surface 89 which makes electrical contact with the contact surface 44 of an associated inside contact 43.

A spring cap 94 is carried by the shaft, and secures the upper portion of the spring 70 in a manner that prevents undesired lateral movement. An upper shaft fastener fastener 95 holds the spring cap 94 in place. A conductive disk biasing spring 94 is carried between the perimeter rim 92 of the insulating support disk 91 and the spring cap 94. When the sliding cylindrical post 50 is in the nonconducting position, seen in FIG. 2, the spring is relaxed. When the sliding cylindrical post 50 is in the conducting position, seen in FIG. 1, the spring is compressed. The force of the coil pulling the main body 51 into the cavity 34 causes the compression. The compressed spring 94 forces the conductive disk 87 firmly against the contact surface 44, thereby reducing electrical resistance.

Figure 4:
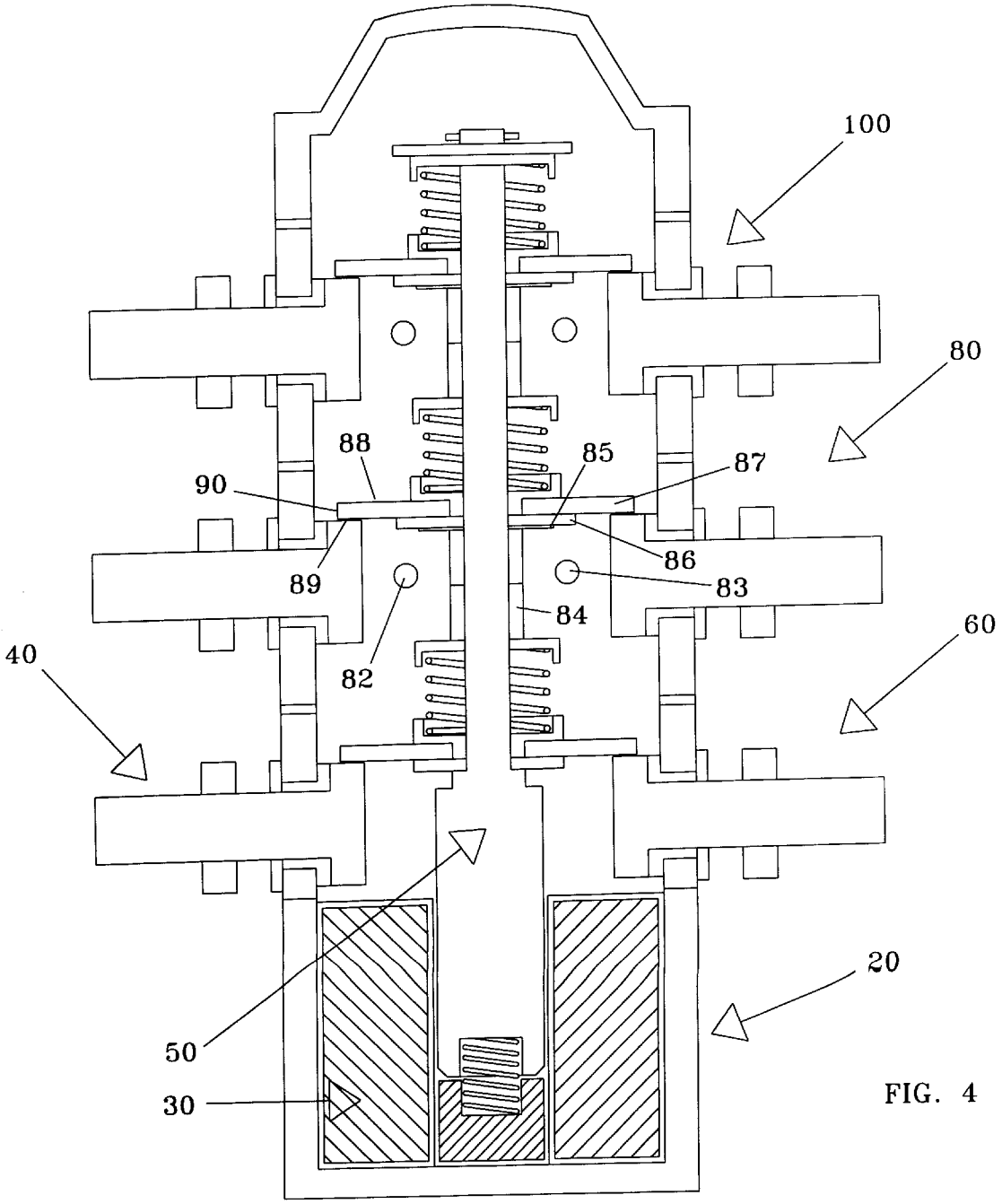
FIG. 4 is an isometric cross-sectional view of a three-stage version of the solenoid switch.

A third stage, seen in FIG. 4, a third stage may be carried by the second stage, and provides a similar structure and functionality. Use of the third stage further reduces the overall resistance and current flow through each stage, and as a result decreases the power consumed and heat produced. As a practical matter, a larger coil may be required, due to the increased resistance to pulling the body 51 against an addition spring.

Figure 6:
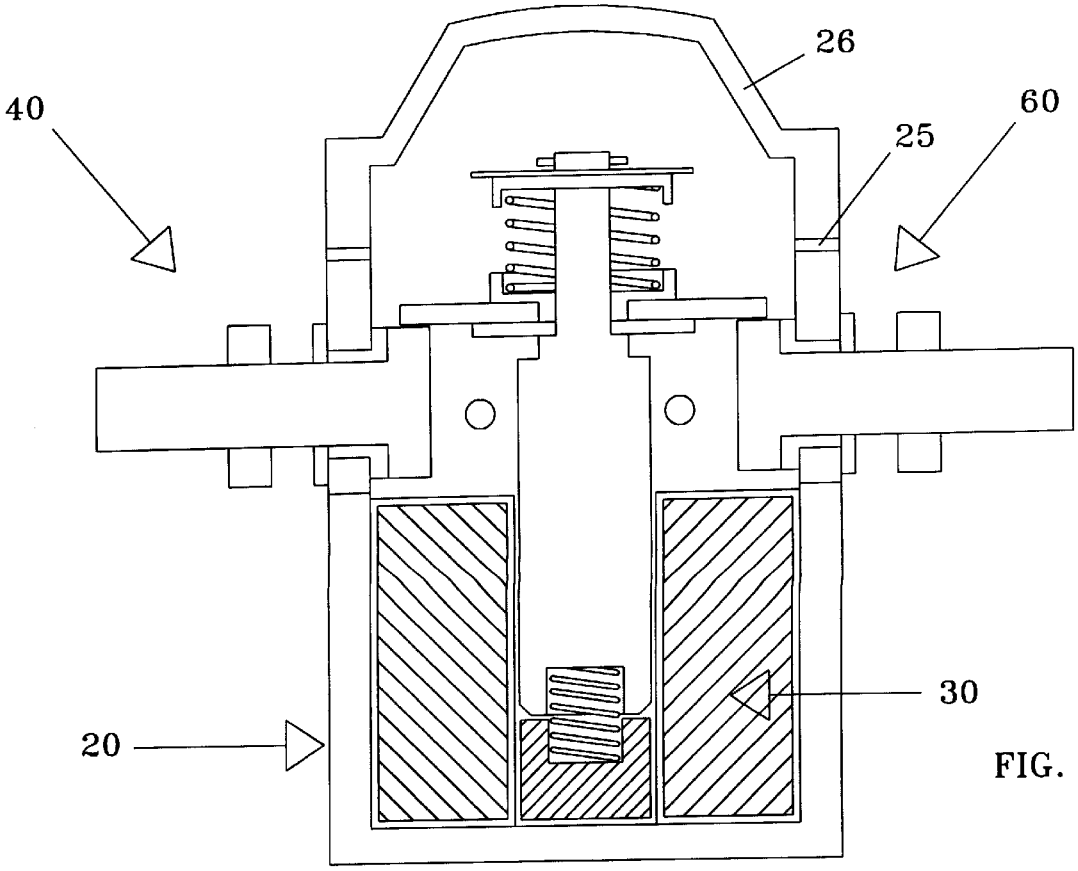
FIG. 6 is an isometric cross-sectional view of a one-stage version of the solenoid switch, having air inlet and air outlet ports.
Figure 7:
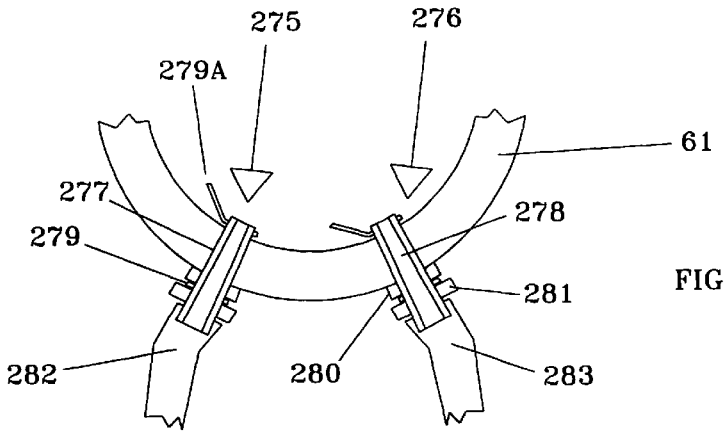
FIG. 7 is a view of the combined terminal post and air inlet/outlet.
Figure 5:
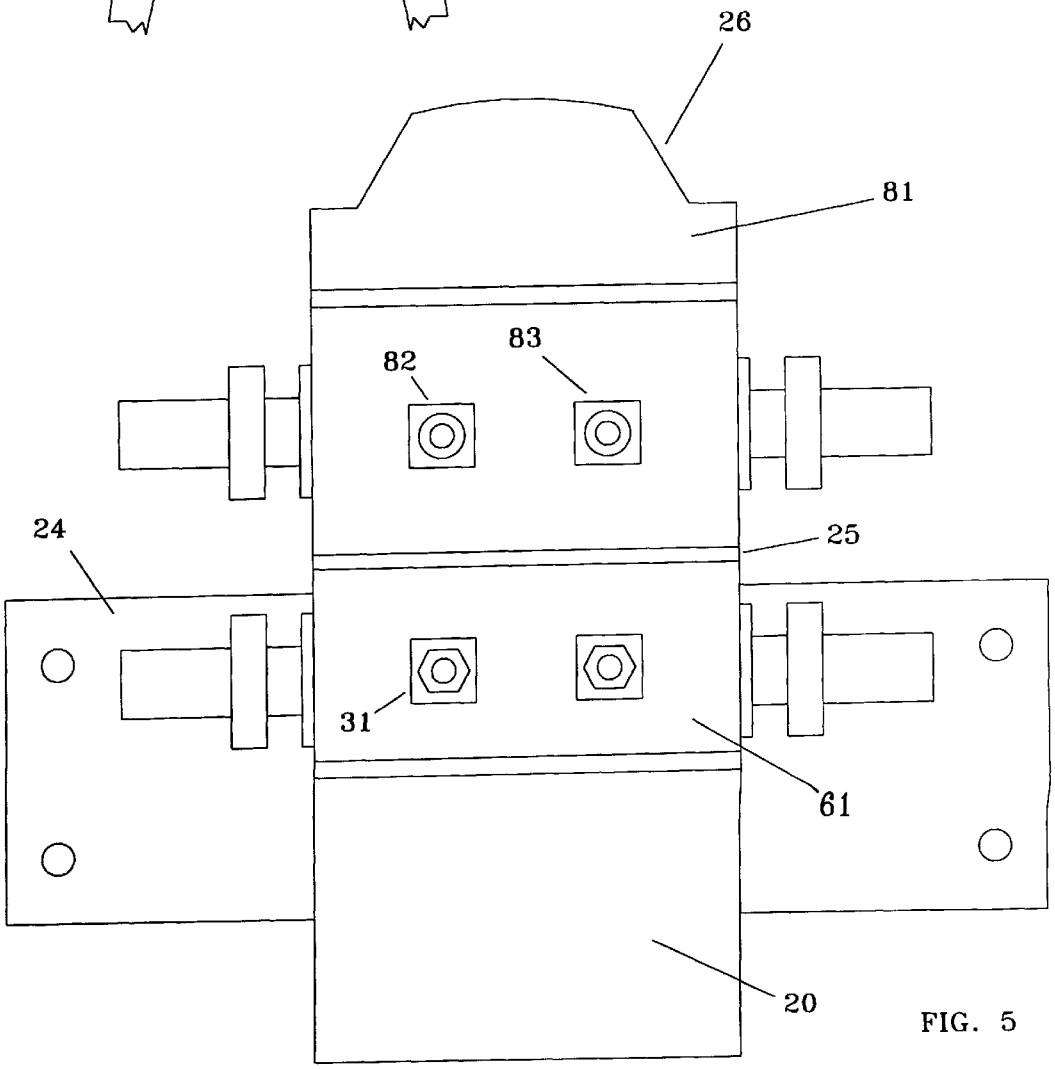
FIG. 5 is an isometric view of the solenoid switch of FIG. 1.

As seen in FIG. 6, a one-stage version of the invention provides a single stage 60, as previously described. However, in a preferred one-stage version, a combined threaded contact post and air inlet 275 and a combined threaded contact post and air outlet 276 each serve dual functions. This structure is best seen in FIG. 7 and can be adapted to the versions of the invention seen in FIGS. 1 through 5. Electrical connection of coil current supply wire 279 made to the contact posts 275, 276 allows control over the coil 30, which is attached to the posts by wire 279A. The connection between the supply wire 279 and the posts is made between contact plate 280 and fastener 281.

Additionally, input and output (exhaust) compressed air hoses 282, 283 with standard fittings may be attached to the air inlet/outlet 275, 276, allowing the one-stage version to be air-cooled.

A preferred method of making the combined electrical contact post and air fitting is to drill, in an axial direction, through a pair of threaded bolts 277 which are electrically wired to the coil. The drilled hole becomes an air passage 278. The control wire to each terminal is then attached between a contact plate 280 and fastener 281. The portion of the hollowed-out threaded bolt 277 which extends beyond the nut 281 is then attached to compressed air or air exhaust tubes.

The previously described versions of the present invention have many advantages, including a primary advantage of providing a novel solenoid switch modified for higher current passage that is air-cooled, and which therefore is resistant to the principle cause of failure, which is overheating.

Another advantage of the present invention is to provide a novel solenoid switch modified for higher current passage that that has a multi-stage design, which results in the redistribution of current through a greater number of electrically conductive disks, thereby reducing electrical resistance and therefore heat production.

A still further advantage of the present invention is to provide a novel solenoid switch modified for higher current passage that provides spacing cylinders supported on the shaft of the sliding post that allow individual adjustment of the pressure applied to each of the electrically conductive disks, which in turn allows equalization of the pressure applied to a number of such disks.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while one-, two-and three-stage versions of the invention are disclosed, it is clear that additional stages could be added, while still in keeping within the scope of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A solenoid switch, for use in controlling the passage of DC current, comprising:

(A) a case, having a cylindrical sidewall having a closed end and an open end;

(B) a coil, carried within the case adjacent to the closed end, the coil defining a cavity;

(C) a core, carried within the cavity defined by the coil, the core defining a spring recess;

(D) a sliding post, carried within the case, movable between conducting and non-conducting positions;

(E) a cylinder biasing spring, carried between the spring recess of the core and a spring recess defined in the main body of the sliding post;

(G) a first stage, comprising:

(a) an insulating disk, carried by the sliding post;

(b) an insulating spring support disk, adjacent to the insulating disk, having an upper surface defining a perimeter rim and having a lower body;

(c) an electrically conductive disk, carried by the lower body of the insulating spring support disk;

(d) a conductive disk biasing spring, carried by the sliding post, and having a first end portion carried within the perimeter rim of the insulating spring support disk; and (e) a spring cap, carried by the shaft and sized to carry a second end portion of the conductive disk biasing spring;

(H) first and second electrical connectors, passing through and carried at diametrically opposed positions on the case; and (I) air inlet and air outlet means to allow circulation of compressed air within the case and cylindrical body, whereby excess heat generated when the sliding post is in the conducting position may be removed.

2. A solenoid switch, for use in controlling the passage of DC current, comprising:

(A) a case, having a cylindrical sidewall having a closed end and a open end;

(B) a coil, carried within the case adjacent to the closed end, the coil defining a cavity;

(C) a core, carried within the cavity defined by the coil, the core defining a spring recess;

(D) a sliding post, carried within the case, movable between conducting and non-conducting positions, the sliding post comprising:

(a) a main body sized for passage within the cavity of the coil, the main body defining a spring recess;

(b) a neck, extending from the main body; and
(c) a shaft, extending from the neck;

(E) a cylinder biasing spring, carried between the spring recess of the core and the spring recess of the main body of the sliding post;

(G) a first stage, comprising:
(a) a first insulating disk, carried by the shaft and in contact with the neck;
(b) a first insulating spring support disk, adjacent to the first insulating disk, having an upper surface defining a perimeter rim and having a lower body;
(c) a first electrically conductive disk, carried by the lower body of the first insulating spring support disk;
(d) a first conductive disk biasing spring, carried by the shaft, and having a first end portion carried within the perimeter rim of the insulating spring support disk; and
(e) a first spring cap, carried by the shaft and sized to carry a second end portion of the first conductive disk biasing spring;

(H) first and second electrical connectors, passing through and carried at diametrically opposed positions on the case, each connector comprising:
(a) an outside portion comprising a threaded bolt extending from a contact surface; and
(b) an inside portion comprising an inside contact having a contact surface, whereby the contact surfaces of the first and second electrical connectors will contact the first electrically conductive disk when the sliding post is in the conducting position, but whereby the contact surfaces of the first and second electrical connectors will not contact the first electrically conductive disk when the sliding post is in the non-conducting position;

(I) a second stage, comprising:
(a) air inlet and air outlet means for allowing circulation of compressed air within the case and cylindrical body, whereby excess heat generated when the sliding post is in the conducting position may be removed;
(b) a second electrically insulating disk, carried by the shaft adjacent to the first spring cap;
(c) at least one spacing cylinder, carried by the shaft adjacent to the second electrically insulating disk;
(d) a second insulating spring support disk, carried by the shaft adjacent to the at least one spacing cylinder, having an upper surface defining a perimeter rim and a lower body;
(e) a second electrically conductive disk, carried by the lower body of the second insulating spring support disk;
(f) a second conductive disk biasing spring, carried by the shaft, and having a first end portion carried within the perimeter rim of the second electrically insulating spring support disk;
(g) a second spring cap, carried by the shaft and sized to carry a second end portion of the second conductive disk biasing spring; and
(h) fastening means, carried by the shaft, for retaining the spring cap; and (J) third and fourth electrical connectors, passing through and carried at diametrically opposed positions on the case, each connector comprising:
(a) an outside portion comprising a threaded bolt extending from a contact surface; and
(b) an inside portion comprising an inside contact having a contact surface, whereby the contact surfaces of the third and fourth electrical connectors will contact the second electrically conductive disk when the sliding post is in the conducting position, but whereby the contact surfaces of the third and fourth electrical connectors will not contact the second electrically conductive disk when the sliding post is in the non-conducting position.

* * * * *